US008714264B2

(12) United States Patent
Fay

(10) Patent No.: US 8,714,264 B2
(45) Date of Patent: May 6, 2014

(54) DUAL BARRIER SIDE POCKET MANDREL

(75) Inventor: Peter J. Fay, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 376 days.

(21) Appl. No.: 13/111,469

(22) Filed: May 19, 2011

(65) Prior Publication Data

US 2012/0292034 A1 Nov. 22, 2012

(51) Int. Cl.
*E21B 34/06* (2006.01)

(52) U.S. Cl.
USPC ..... 166/372; 166/375; 166/319; 166/332.1

(58) Field of Classification Search
USPC ..... 166/372, 373, 375, 319, 374, 332.1
See application file for complete search history.

(56) References Cited

U.S. PATENT DOCUMENTS

| | | | | |
|---|---|---|---|---|
| 4,239,082 | A * | 12/1980 | Terral | 166/117.5 |
| 6,082,455 | A * | 7/2000 | Pringle et al. | 166/250.15 |
| 6,422,312 | B1 * | 7/2002 | Delatorre et al. | 166/250.15 |
| 7,228,909 | B2 | 6/2007 | Schmidt et al. | |
| 2006/0137881 | A1 * | 6/2006 | Schmidt et al. | 166/372 |
| 2011/0315401 | A1 * | 12/2011 | White et al. | 166/385 |

OTHER PUBLICATIONS

Weatherford International Ltd., "SBRO-DVX Side Pocket Gas-Lift Mandrel", 2005-2009, 2 pages.

* cited by examiner

*Primary Examiner* — Kenneth L Thompson
(74) *Attorney, Agent, or Firm* — Steve Rosenblatt

(57) ABSTRACT

A side pocket mandrel has openings to receive a plurality of valves such that the flow of fluid from outside the string and into the tubular such as in gas lift will flow through the valves in series. The side pocket mandrel that has a single valve pocket can also be used in tandem with another similar side pocket mandrel to get the same dual barrier configuration to meet requirements of many jurisdictions of such a valve arrangement for tubular wall openings.

11 Claims, 2 Drawing Sheets

DUAL BARRIER SIDE POCKET MANDREL

FIELD OF THE INVENTION

The field of the invention relates to side pocket mandrels and more particularly those used in gas lift operations and configured to provide double barrier protection between the tubing and the surrounding annular space.

BACKGROUND OF THE INVENTION

Gas lift is a technique where fluid is injected into the string to aid the produced fluids to get to the surface. One way this is done is with side pocket mandrels. Side pocket mandrels are tubular structures fitted into a string at predetermined locations and include an internal side compartment where a valve can be installed without reduction of the string drift dimension. The side pocket has a wall opening and the valve is used to control the rate of fluid that can be injected into the string at the location of each of the side pocket mandrels that are in service for a particular string.

Some designs have tandem valves with separate check valves so that one can be taken out of service without opening communication between the tubing and the casing. Such a design is shown in U.S. Pat. No. 7,228,909 and in model SBRO-DVX side pocket mandrel sold by Weatherford International Ltd. of Houston, Tex. These tandem gas lift valve designs in a side pocket mandrel were built to address issues of capacity or pressure drop in operation and to provide workover capability of removing one of the valve assemblies in a workover and going back in service with a backup. In essence the dual gas lift design of the past ran the gas lift valves in parallel to increase gas injection flow and/or reduce pressure drop across such valves. Check valves associated with each pocket kept tubing pressure in the tubing to protect the surrounding casing from overpressure if the valves are removed from the pockets.

These designs fail to address requirements in many jurisdictions for dual barriers for any wall opening in a tubular string and the surrounding annular space regardless of whether that annular space is open to a formation being produced or is isolated from it with a packer. The present invention offers this capability and a compact design with the possibility of retrofitting of existing side pocket mandrel designs that have two or more locations for inserting valves. An alternative for single valve side pocket mandrels is to run two close to each other and provide control line connection of the valves for capability of running the valves in series. Preferably the passages in the side pocket mandrel can be internally configured to conduct flow in parallel to meet the double barrier requirements of many jurisdictions for isolation of tubular wall openings. Those skilled in the art can get a better understanding of the invention from a review of the description of the preferred embodiment and the associated drawings with an understanding that the full scope of the invention is to be determined by the appended claims.

SUMMARY OF THE INVENTION

A side pocket mandrel has openings to receive a plurality of valves such that the flow of fluid from outside the string and into the tubular such as in gas lift will flow through the valves in series. The side pocket mandrel that has a single valve pocket can also be used in tandem with another similar side pocket mandrel to get the same dual barrier configuration to meet requirements of many jurisdictions of such a valve arrangement for tubular wall openings.

DETAILED DESCRIPTION OF THE PREFERRED EMBODIMENT

Figure 2:
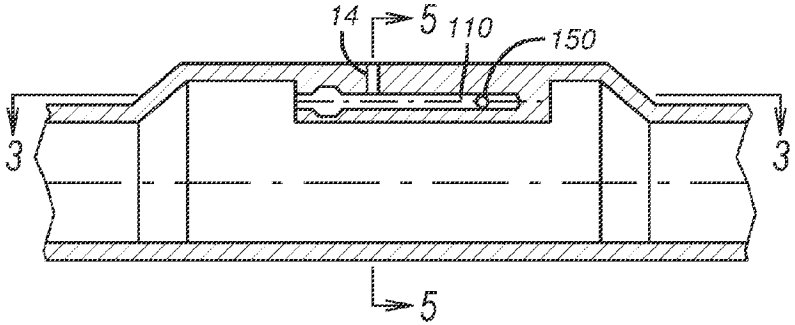
FIG. 2 is the view along line 2-2 of FIG. 1.
Figure 3:
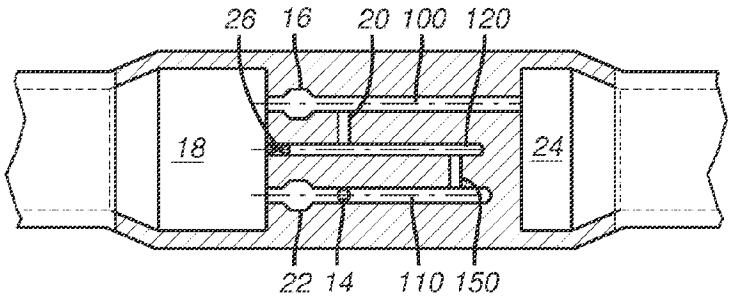
FIG. 3 is the view along line 3-3 of FIG. 2.
Figure 4:
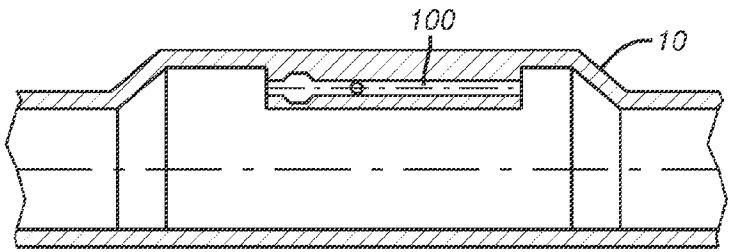
FIG. 4 is the view along line 4-4 of FIG. 1.
Figure 1:
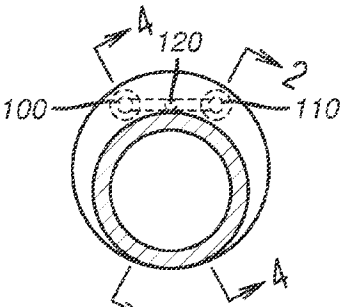
FIG. 1 is an end view of a dual valve side pocket mandrel.
Figure 5:
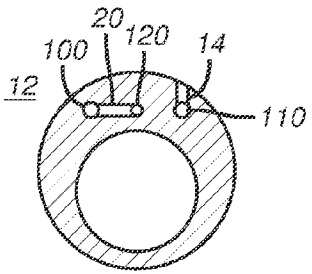
FIG. 5 is the view along line 5-5 of FIG. 2.

The side pocket mandrel 10 has at least two pockets 100 and 110 that are interconnected through passage 120 that is preferably between them. Flow enters from the surrounding annular space 12 into inlet 14 seen in FIG. 5. Inlet 14 is below latch profile 22 where a known valve (not shown) is securely mounted to seal off the interior passage 18 while allowing flow to go transversely into passage 150 and into passage 120. Once the flow gets to passage 120 there is a transverse passage 20 that leads to passage 100 where another valve (not shown) is located and latched at profile 16. The valve latched at 16 allows selective access to passage 24 that communicates with the interior passage 18 of the side pocket mandrel 10. Thus flow goes in series through the valves latched at 22 and 16 respectively as the flow from the annulus such as gas injected for a gas lift operation enters from passage 14 and is allowed to pass through passage 110 and continue into transfer passage 150 into passage 120 and out of passage 120 to passage 20 where the valve latched at 16 can selectively allow passage to opening 24 that communicates with the interior of the side packet mandrel 10.

Figure 6:
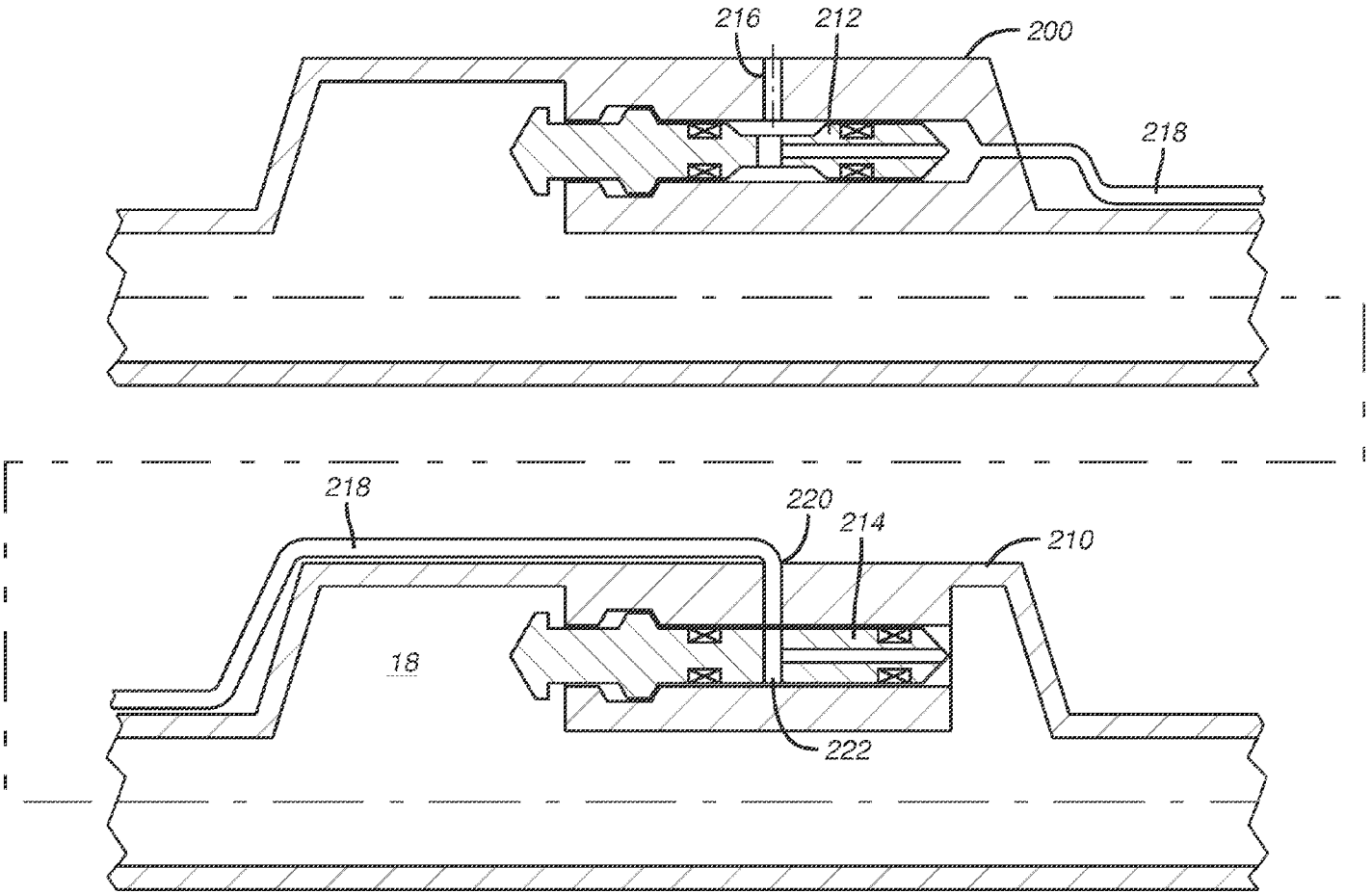
FIG. 6 shows two side pocket mandrels in series with each having a single pocket and an external jumper line to connect the pockets.

It should be noted that there is a plug 26 that isolates passage 120 from interior passage 18. Passages 100 and 110 are preferably smooth walled to act as seal bores for the valves latched at profiles 16 and 22. While the side pocket mandrel 10 that is illustrated in FIGS. 1-5 is configured for two valves in series, other configurations that have more valves in a single side pocket mandrel 10 are contemplated as are sequential arrangements, shown in FIG. 6, of multiple side pocket mandrels 200 and 210 that for example have a single valve 212 or 214 but one is ported at 216 for intake from the annulus 12 and an exit via an external conduit 218 between adjacent side pocket mandrels to an inlet 220 in the side pocket mandrel above where a second valve is disposed in the pocket and controls the inflow from the external conduit 218 to an outlet 222 into the passage 18 of an upper of two side pocket mandrels 200 and 210 in series in a tubular string. The mandrels can also be close fitted so that in lieu of an external conduit internal passages between adjacent mandrels can be part of the series connection of the valves in the pockets of the adjacent housings.

Retrofitting existing side pocket mandrels with two pockets for series rather than parallel flow is envisioned assuming the size in question leaves room in the wall to add another pocket that serves the function comparable to passage 120 and with transverse passages added so that the newly added pocket can communicate the adjacent pockets with the newly added pocket in a series path from one existing pocket to the next.

Each pocket such as 100 and 110 can have a check valve associate with it or in an adjacent transverse passage that prevents flow into the annulus if the pockets are left empty from a removal of a valve for maintenance or any other reason.

While the preferred embodiment connects the two valves in series through an intermediate passage 120 the use of such a passage is optional and a transverse passage can go between the pockets 110 and 100 directly depending on the size of the housing and the angular separation between the pockets. The transverse passages such as 20 and 150 can be drilled from the housing exterior and then closed with a threaded plug or the equivalent.

The above description is illustrative of the preferred embodiment and many modifications may be made by those skilled in the art without departing from the invention whose scope is to be determined from the literal and equivalent scope of the claims below:

I claim:

1. A side pocket mandrel assembly for a subterranean tubular string having a surrounding annular space, comprising at least one housing assembly having a central passage and further comprising at least two side pockets in said housing;

at least two valves insertable in said pockets;

a flow passageway extending in series through said pockets to allow selective multi-valve closure of said passageway that extends from the annular space at one end and the central passage of said housing assembly at an opposite end.

2. The assembly of claim 1, wherein:

said at least one housing assembly comprises a plurality of housings with at least one pocket in each housing.

3. The assembly of claim 1, wherein:

said two side pockets are in a single housing.

4. The assembly of claim 3, wherein:

said two side pockets are connected by at least one transverse passage in the wall of said housing.

5. The assembly of claim 1, wherein:

isolation between said annular space and the central passage is still possible with one of said pockets operating without a valve.

6. The assembly of claim 5, wherein:

one of said pockets is closest to said central passage;

isolation between said annular space and the central passage is still possible with said pocket in said flow passageway closest to said central passage operating without a valve.

7. A side pocket mandrel assembly for a subterranean tubular string having a surrounding annular space, comprising at least one housing assembly having a central passage and further comprising at least two side pockets;

at least two valves insertable in said pockets;

a flow passageway extending in series through said pockets to allow selective multi-valve closure of said passageway that extends from the annular space at one end and the central passage of said housing assembly at an opposite end;

said at least one housing assembly comprises a plurality of housings with at least one pocket in each housing;

pockets in different housings are connected in series externally to said housings with a conduit.

8. The assembly of claim 7, wherein:

different housings abut each other and the pockets in adjacent housings are connected through said housings without an external conduit.

9. A side pocket mandrel assembly for a subterranean tubular string having a surrounding annular space, comprising at least one housing assembly having a central passage and further comprising at least two side pockets;

at least two valves insertable in said pockets;

a flow passageway extending in series through said pockets to allow selective multi-valve closure of said passageway that extends from the annular space at one end and the central passage of said housing assembly at an opposite end;

said two side pockets are in a single housing;

said two side pockets are connected by at least one transverse passage in the wall of said housing;

said housing further comprises an additional passage in the wall of said housing and disposed between said pockets;

said at least one transverse passage comprises at least two passages to communicate flow from one pocket into the additional passage and out of the additional passage and into another pocket in said housing.

10. The assembly of claim 9, wherein:

said additional passage is isolated from said central passage.

11. The assembly of claim 10, wherein:

said additional passage is closed with a plug in an open end that would otherwise communicate with said central passage.

* * * * *